US010320123B1

(12) United States Patent
Sundarakrishnamachari et al.

(10) Patent No.: US 10,320,123 B1
(45) Date of Patent: Jun. 11, 2019

(54) RIGHT ANGLE CONNECTOR WITH TERMINAL CONTACT PROTECTION

(71) Applicant: Delphi Technologies, LLC, Troy, MI (US)

(72) Inventors: Rangarajan Sundarakrishnamachari, Royapettah (IN); Lokesh Dayalan, Vellore (IN)

(73) Assignee: Delphi Technologies, LLC, Troy, MI (US)

( * ) Notice: Subject to any disclaimer, the term of this patent is extended or adjusted under 35 U.S.C. 154(b) by 0 days.

(21) Appl. No.: 15/897,520

(22) Filed: Feb. 15, 2018

(51) Int. Cl.

| | |
|---|---|
| ***H01R 13/64*** | (2006.01) |
| ***H01R 13/44*** | (2006.01) |
| ***H01R 13/502*** | (2006.01) |
| ***H01R 13/703*** | (2006.01) |

(52) U.S. Cl.
CPC ..... *H01R 13/64* (2013.01); *H01R 13/44* (2013.01); *H01R 13/502* (2013.01); *H01R 13/7031* (2013.01)

(58) Field of Classification Search
CPC ..... H01R 13/64
See application file for complete search history.

(56) References Cited

U.S. PATENT DOCUMENTS

| | | | | |
|---|---|---|---|---|
| 4,083,619 | A * | 4/1978 | McCormick | H01R 13/62 439/310 |
| 4,832,625 | A * | 5/1989 | Puerner | H01R 13/64 439/681 |
| 4,986,769 | A * | 1/1991 | Adams, III | H01R 13/64 439/347 |
| 5,211,585 | A * | 5/1993 | Douty | H01R 13/64 439/248 |
| 9,431,771 | B1 * | 8/2016 | Sundarakrishnamachari | H01R 13/514 |

* cited by examiner

*Primary Examiner* — James Harvey
(74) *Attorney, Agent, or Firm* — Robert J Myers

(57) ABSTRACT

A connector assembly, such as a shielded high voltage electrical connector assembly, includes an outer housing having a guide post extending parallel to a mating axis and an inner housing slideably attached to the outer housing. The inner housing is configured to move along the mating axis from a first position to a second position. The inner housing comprises a guide tube that extends parallel to the mating axis. The guide tube defines a guide cavity that extends through the guide tube in a direction parallel to the mating axis. At least a portion of the guide post is disposed within the guide cavity when the inner housing is in the first position and in the second position.

8 Claims, 5 Drawing Sheets

RIGHT ANGLE CONNECTOR WITH TERMINAL CONTACT PROTECTION

TECHNICAL FIELD OF THE INVENTION

The invention relates to connectors, particularly connectors configured to prevent inadvertent contact with terminals.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a connector system having a first connector and a second connector that each contain termination elements or "terminals" for wire electrical cables, fiber optic cables, pneumatic lines, hydraulic lines, etc. The outer housing of the first connector includes a moveable inner housing, referred to hereafter as a terminal protection device (TPD). The TPD moves along a mating axis of the first and second connectors from a first position wherein the terminals in the first connector are protected by the TPD to a second position where a portion of the terminals protrude through the TPD when the first connector is connected to the second connector. The TPD is held in the first position until released by the second connector during the connection of the first connector with the second connector. When the first and second connectors are disconnected, the second connector pulls the TPD from the second position back to the first position, thus reestablishing protection of the terminals. An example of means for moving the TPD from the first position to the second position are shown in U.S. Pat. No. 9,608,357, the entire disclosure of which is hereby incorporated by reference herein. The connector system presented herein further includes means for guiding the TPD along the mating axis to minimize wobbling or other off-axis movements of the TPD that may interfere with the movement between the first and second positions.

Figure 1:
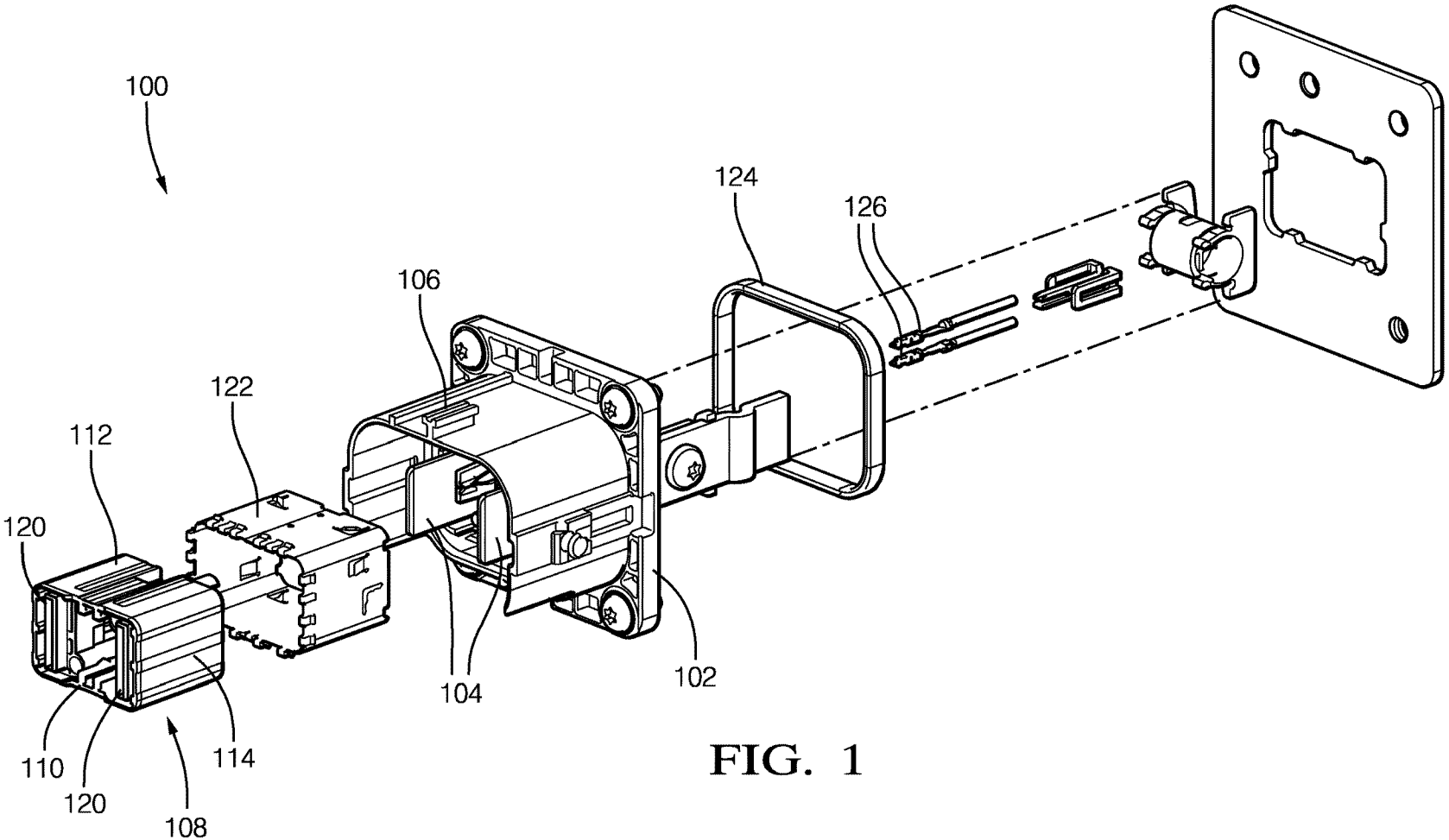
FIG. 1 is an exploded perspective view of a connector assembly according to one embodiment.

FIGS. 1 through 8 illustrate a non-limiting example of a connector system, in this particular example an electrical connector system for high voltage applications, i.e. greater than 48 volts. As shown in FIG. 1, the connector assembly includes a first connector 100 having an outer housing 102 containing a pair of male blade terminals 104 terminating a pair of wire electrical cables or conductive bus bars (not shown). The first connector 100 is based around the outer housing 102 to which the other components of the first connector 100 are attached. The outer housing 102 is formed of a dielectric material, such as polybutylene terephthalate (PBT), polypropylene (PP), or polyamide (PA, commonly known as NYLON). The outer housing 102 defines a U-shaped shroud 106 around the male blade terminals 104.

The connector system further includes a second connector (not shown) containing a pair of corresponding female socket terminals terminating a pair of wire electrical cables that are configured to mate with the male blade terminals 104.

Figure 2:
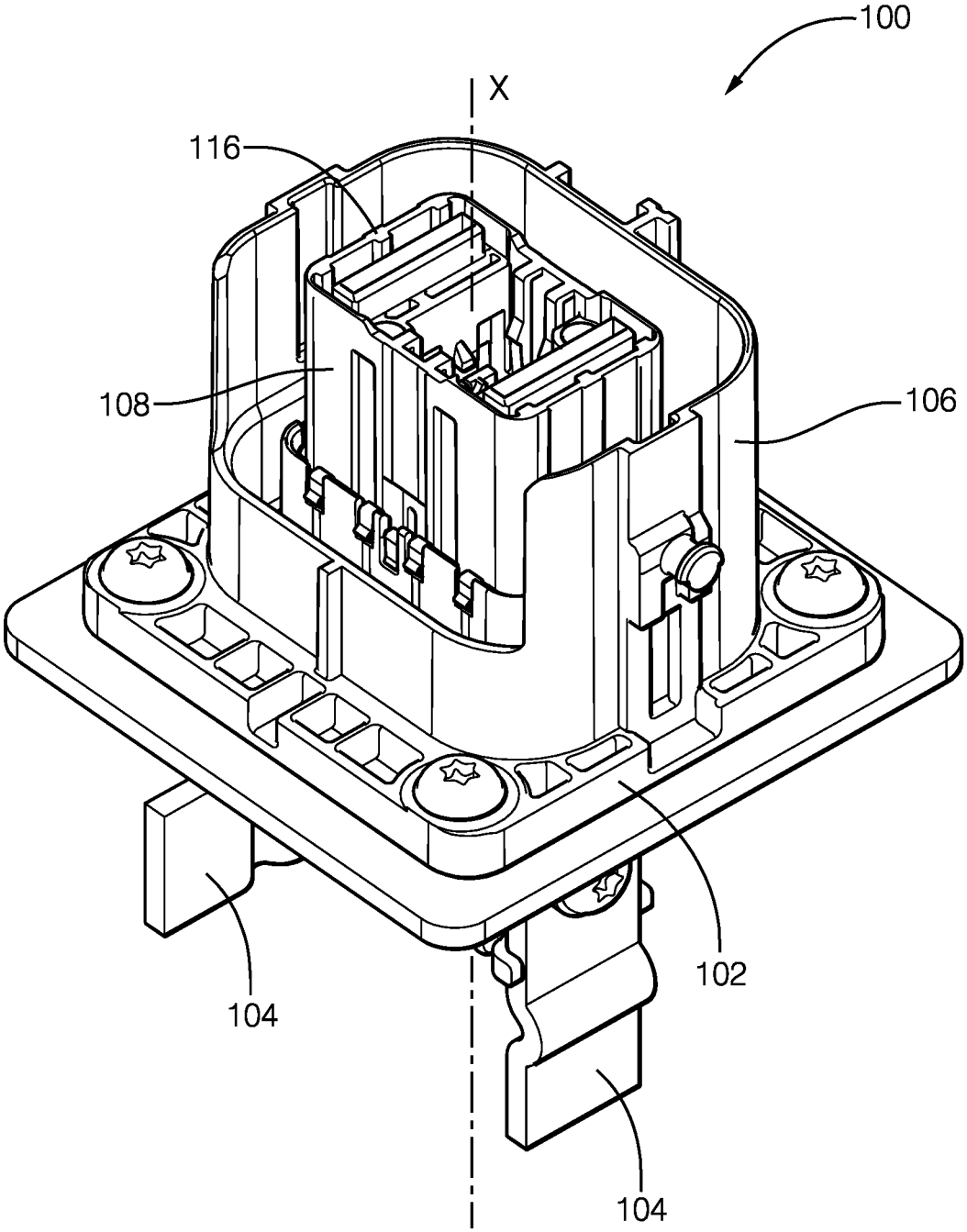
FIG. 2 is a side perspective view of the connector system of FIG. 1 having an inner housing in a first position enclosing a terminal within an outer housing according to one embodiment.
Figure 3:
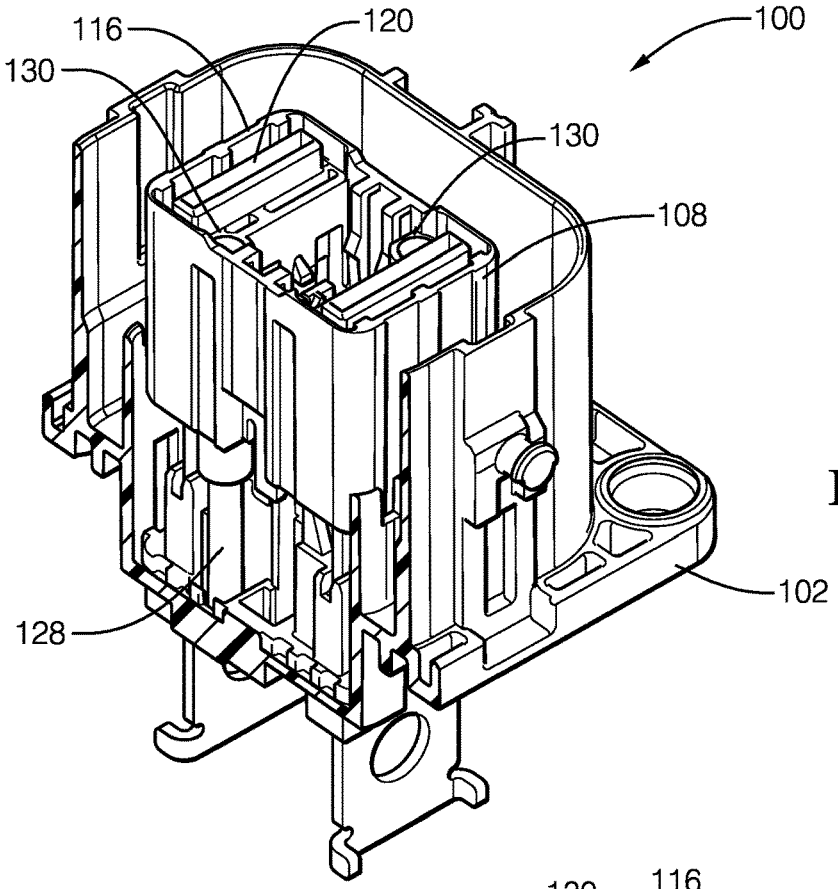
FIG. 3 is a cutaway side perspective view of the connector system of FIG. 1 having the inner housing in the first position according to one embodiment.
Figure 7:
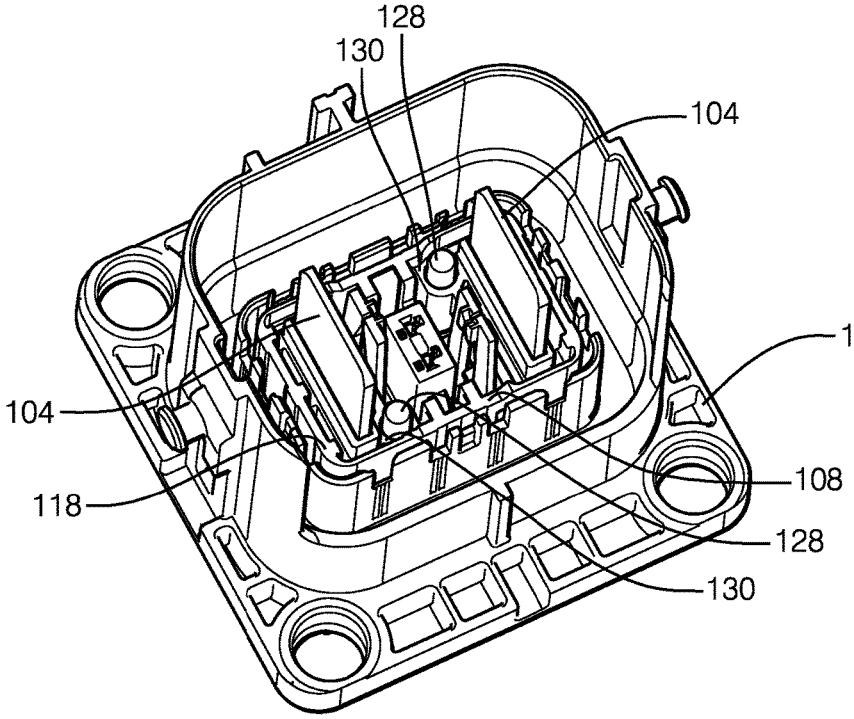
FIG. 7 is a side perspective view of the connector system of FIG. 1 having the inner housing in a second position in which the terminal protrudes from the outer housing according to one embodiment.

As shown in FIG. 1 the first connector also includes an inner housing, hereinafter referred to as a terminal protection device 108 (TPD), that is slideably attached to the outer housing 102. The TPD 108 is configured to protect the male blade terminals 104 from inadvertent contact by an operator when the first connector 100 is connected with or disconnected from the second connector. The TPD 108 is formed of a dielectric material such as PBT, PP, or NYLON. The TPD 108 has a generally open rectangular box shape having a top wall 110, two major side walls 112 and two minor side walls 114. The TPD 108 is configured to move from a first position 116 wherein the male blade terminals 104 are enclosed within the TPD 108 as shown in FIG. 2 to a second position 118 wherein a portion of the male blade terminals 104 protrudes through a pair of apertures 120 defined in the top wall 110 of the TPD 108 as shown in FIG. 7. The TPD 108 is configured to enclose the male blade terminals 104 when the TPD 108 is in the first position 116, thus preventing accidental contact by a finger of an assembly operator or a foreign conductive element, such as a screwdriver or wrench, with the male blade terminals 104 when the first connector 100 is not mated with the second connector.

As shown in FIG. 1, the first connector 100 also has a conductive shield 122 around the terminals 104 in order to provide electromagnetic shielding of the terminals 104. The first connector 100 further includes a compliant seal 124 that is configured to contact the bottom of the outer housing 102 and the mounting surface for the first connector 100, thereby protecting the terminals 104 against intrusion of environmental contaminants, such as water spray or dust.

As also shown in FIG. 1, the first connector 100 includes a pair of HVIL terminals 126 that are interconnected by a shunt in the second connector when the first and second connectors are fully mated. The HVIL terminals 126 are linked to a control circuit (not shown) that inhibits the male blade terminals 104 in the first connector 100 from being energized until the HVIL terminals 126 are shorted by the HVIL shunt. The length of the blades of the HVIL shunt is selected to ensure that the female and male terminals in the first and second connectors are properly connected before the HVIL shunt interconnects the HVIL terminals 126, thus triggering the HVIL circuit to energize the male blade terminals 104.

The TPD 108 also encloses the HVIL terminals 126 when the TPD 108 is in the first position 116, thus preventing accidental contact by a foreign conductive element with the HVIL terminals 126 that could form a short circuit between the HVIL terminals 126 and inappropriately enable the HVIL circuit. When the TPD 108 is moved to the second position 118, the HVIL terminals 126 are allowed to make contact with the HVIL shunt in the second connector.

Figure 4:
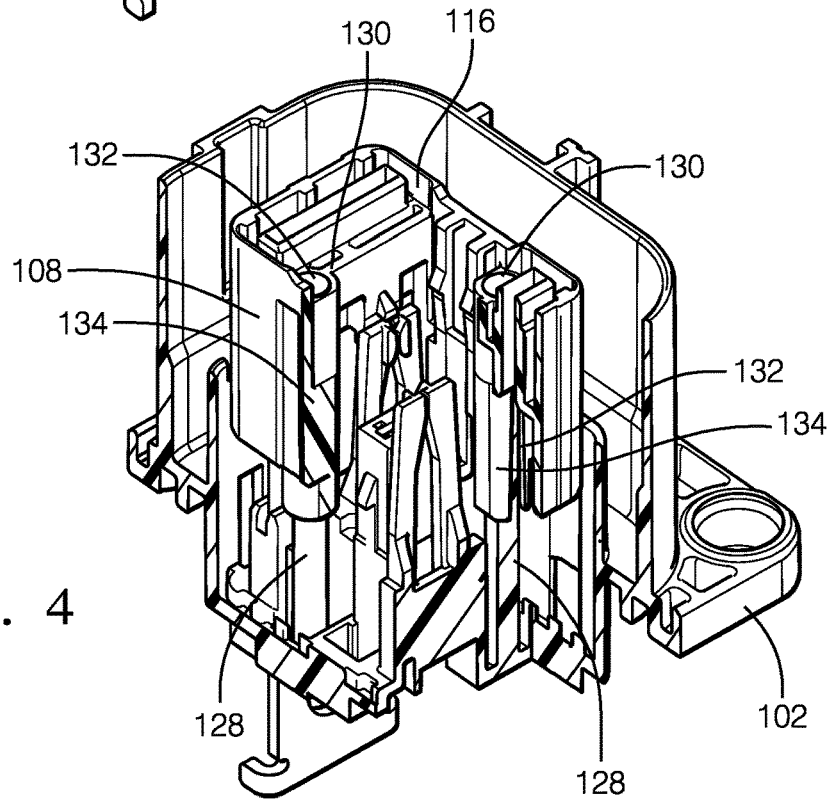
FIG. 4 is an alternative cutaway side perspective view of the connector system of FIG. 1 having the inner housing in the first position according to one embodiment.
Figure 5:
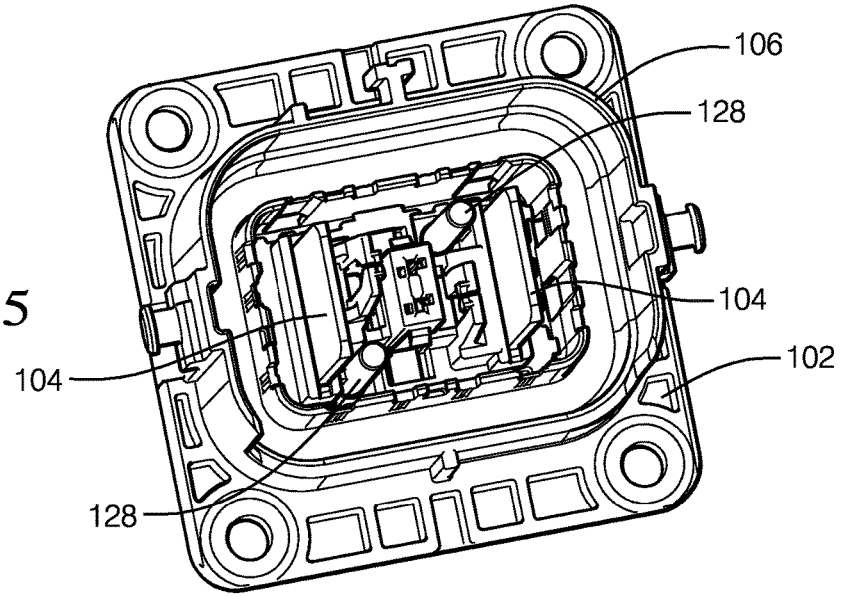
FIG. 5 is a top perspective view of the outer housing with the inner housing removed according to one embodiment.
Figure 6:
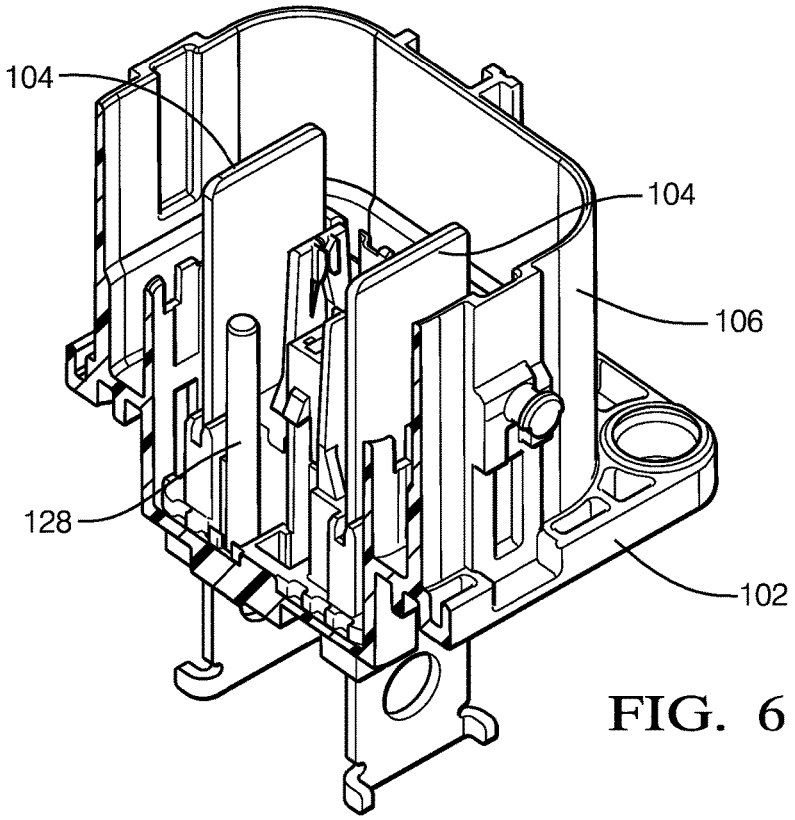
FIG. 6 is a cutaway side perspective view of the outer housing with the inner housing removed according to one embodiment.

As best shown in FIGS. 5 and 6, the TPD 108 further includes a pair of guide posts 128 extending in a direction parallel to a mating axis X. These guide posts 128 are best shown in FIG. 4. Each of the pair of guide posts 128 is characterized as having a cylindrical shape. Each of the pair of guide posts 128 are diagonally offset from one another relative to the mating axis X and to the pair of male blade terminals 104. The guide posts 128 are integrally formed with the outer housing 102.

Figure 8:
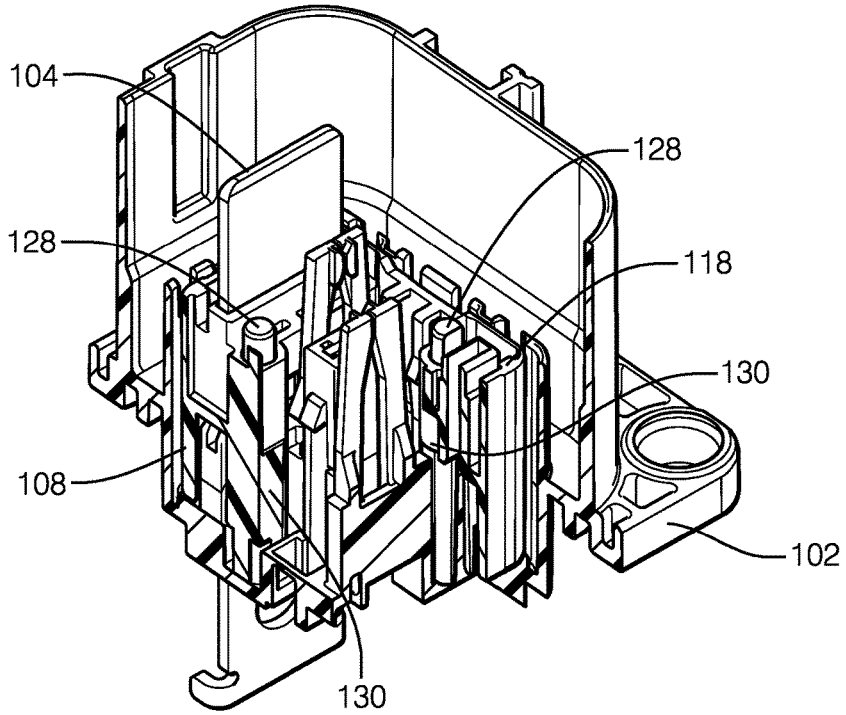
FIG. 8 is a cutaway side perspective view of the connector system of FIG. 1 having the inner housing in the second position according to one embodiment.

As best shown in FIGS. 4, 7, and 8, the TPD 108 further defines a pair of guide tubes 130 extending parallel to the mating axis X. Each of the pair of guide tubes 130 define a guide cavity 132 that extends through the pair of guide tubes 130 in the direction parallel to the mating axis X surrounded by a guide tube wall 134. The guide tubes 130 are integrally formed with the TPD 108. Each of the pair of guide cavities 132 is characterized as having a cylindrical shape. A portion of one of the pair of guide posts 128 is received within one of the pair of guide cavities 132 and a portion of the other pair of guide posts 128 is received within the other pair of guide cavities 132. At least a portion of each of the pair of guide posts 128 is disposed within one of the pair of guide cavities 132 when the TPD 108 is in the first position 116 and in the second position 118. The guide posts 128 and the guide tubes 130 cooperate to limit lateral movement, i.e. movement generally orthogonal to the mating axis X, of the TPD 108 as it moves from the first position 116 to the second position 118. The diameters of the guide posts 128 and the guide cavities 132 are selected so that they minimize this lateral motion without binding.

As best shown in FIG. 4, the pair of guide posts 128 occupy about half of the volume of the pair of guide cavities 132, i.e. the pair of guide posts 128 are received within about half of the length of the pair of guide cavities 132 when the TPD 108 is in the first position 116. As used herein, "about half of the volume" is defined as being between 40% to 60% of the volume. As best shown in FIGS. 7 and 8, the pair of guide posts 128 occupy nearly all of the volume of the guide cavities 132, i.e. the pair of guide posts 128 are received within the entire length of the pair of guide cavities 132 when the TPD 108 is in the second position 118. As used herein, "nearly all of the volume" is defined as being more than 90% of the volume.

The guide tubes 130 are arranged so that they are within the major and minor side walls 112, 114 of the TPD 108, i.e. the guide tubes 130 are surrounded by the side walls 112, 114 of the TPD 108. This provides the benefit of allowing the shield 122 to surround the terminals 104 without requiring openings or slots in the shield 122 to accommodate any guide features for the TPD 108 that would degrade the shielding effectiveness.

Accordingly, a connector assembly is provided. The connector assembly a terminal protection device 108 (TPD 108) that moves along the mating axis X from a first position 116 in which terminals 104 of the connector assembly are enclosed and protected within the TPD 108 to a second position 118 in which the terminals 104 protrude from the TPD 108 allowing interconnection of the terminals 104 with corresponding mating terminals. The TPD 108 is guided from the first position 116 to the second position 118 by guide posts 128 and guide tubes 130 that limit the lateral movement of the TPD 108. The guide tubes 130 are positioned within the side walls 112 of the TPD 108 so that there is no need to provide any openings in a shield 122 surrounding the terminal that may degrade the effectiveness of the shield 122.

The example presented herein is directed to an electrical connector assembly, however other embodiments may be envisioned that are adapted for use with optical cables or hybrid connectors including both electrical and optical cable connections. Yet other embodiments of the connector system may be envisioned that are configured to interconnect pneumatic or hydraulic lines.

Although the illustrated embodiment of the connector assembly shown herein includes an HVIL shunt and HVIL terminals 126, other embodiments of the connector assembly may be envisioned without those elements in applications of the connector assembly where a high voltage interlock circuit is not required. Additionally while the illustrated examples of the guide posts 128 and guide cavities 132 have a cylindrical shape with a generally round cross section, other embodiments of the invention may be envisioned wherein the guide posts and guide cavities have complementary, non-round cross sections.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A connector assembly, comprising:

an outer housing including a guide post extending parallel to a mating axis; and an inner housing slideably attached to the outer housing and configured to move along the mating axis from a first position to a second position, wherein the inner housing comprises a guide tube extending parallel to the mating axis, said guide tube defining a guide cavity extending through the guide tube parallel to the mating axis, and wherein at least a portion of the guide post is disposed within the guide cavity when the inner housing is in the first position and in the second position.

2. The connector assembly according to claim 1, wherein the guide post occupies about 50% of the guide cavity when the inner housing is in the first position and the guide post occupies about 100% of the guide cavity when the inner housing is in the second position.

3. The connector assembly according to claim 2, wherein the guide post is characterized as having a cylindrical shape and the guide cavity is characterized as having a complementary cylindrical shape.

4. An electrical connector assembly, comprising:

an outer housing including a pair of guide posts extending parallel to a mating axis;

a pair of electrical terminals secured within the outer housing; and an inner housing defining a pair of apertures slideably attached to the outer housing, wherein the inner housing is configured to move along the mating axis from a first position in which the pair of electrical terminals is contained within the inner housing to a second position in which the pair of electrical terminals extend through the pair of apertures, wherein the inner housing comprises a pair of guide tubes extending parallel to the mating axis, said pair of guide tubes each defining a guide cavity extending through the pair of guide tubes parallel to the mating axis, and wherein at least a portion of each of the pair of guide posts is disposed within one of the pair of guide cavities when the inner housing is in the first position and in the second position.

5. The electrical connector assembly according to claim 4, wherein each of the pair of guide posts occupies about half of a volume of one of the pair of guide cavities when the inner housing is in the first position and each of the pair of guide posts occupies the nearly all of the volume of one of the pair of guide cavities when the inner housing is in the second position.

6. The electrical connector assembly according to claim 5, wherein each of the pair of guide posts is characterized as having a cylindrical shape and each one of the pair of guide cavities is characterized as having a complementary cylindrical shape.

7. The electrical connector assembly according to claim 6, wherein each of the pair of guide posts are diagonally offset from one another relative to the mating axis and wherein each of the pair of guide tubes and guide cavities are diagonally offset from one another relative to the mating axis.

8. The electrical connector assembly according to claim 7, wherein the inner housing defines a side wall extending along the mating axis and surrounding the pair of electrical terminals and wherein the pair of guide tubes are disposed within the side wall.

* * * * *